US008133135B2

(12) United States Patent
Stites et al.

(10) Patent No.: US 8,133,135 B2
(45) **Date of Patent: *Mar. 13, 2012**

(54) HIGH MOMENT OF INERTIA WOOD-TYPE GOLF CLUBS AND GOLF CLUB HEADS

(75) Inventors: John Thomas Stites, Weatherford, TX (US); Gary G. Tavares, Azle, TX (US); Robert Boyd, Euless, TX (US); Hiroshi Kawaguchi, Southlake, TX (US); Daisuke Tsukada, Niigata-ken (JP)

(73) Assignee: NIKE, Inc., Beaverton, OR (US)

( * ) Notice: Subject to any disclaimer, the term of this patent is extended or adjusted under 35 U.S.C. 154(b) by 48 days.

This patent is subject to a terminal disclaimer.

(21) Appl. No.: 12/141,580

(22) Filed: Jun. 18, 2008

(65) Prior Publication Data

US 2009/0048035 A1 Feb. 19, 2009

Related U.S. Application Data

(60) Provisional application No. 61/007,929, filed on Jun. 21, 2007.

(51) Int. Cl.
*A63B 53/04* (2006.01)

(52) U.S. Cl. ..... 473/342; 473/334; 473/335; 473/345; 473/349

(58) Field of Classification Search ..... 473/324–350, 473/287–292
See application file for complete search history.

(56) References Cited

U.S. PATENT DOCUMENTS

| | | | | |
|---|---|---|---|---|
| 5,451,056 | A * | 9/1995 | Manning | 473/328 |
| 5,788,584 | A * | 8/1998 | Parente et al. | 473/290 |
| 6,149,534 | A * | 11/2000 | Peters et al. | 473/345 |
| 6,368,234 | B1 * | 4/2002 | Galloway | 473/349 |
| 6,471,603 | B1 * | 10/2002 | Kosmatka | 473/324 |
| 6,739,983 | B2 | 5/2004 | Helmstetter et al. | |

(Continued)

FOREIGN PATENT DOCUMENTS

JP 07284546 A 10/1995

(Continued)

OTHER PUBLICATIONS

International Preliminary Report on Patentability in corresponding PCT Application, International Application No. PCT/US2008/067499 mailed Jan. 7, 2010.

(Continued)

*Primary Examiner* — Sebastiano Passaniti
(74) *Attorney, Agent, or Firm* — Banner & Witcoff, Ltd

(57) ABSTRACT

Wood-type golf club heads include: (a) a club head body including heel, toe, crown, sole, and weighted rear portions; and (b) a variable thickness ball striking face. The club head body parts and weighted portion(s) may be arranged such that the club head has a moment of inertia about a vertical axis passing through the club head center of gravity of at least 5000 g-cm$^2$. Such club heads may include: (a) a cup face member including a ball striking face portion and a return portion; (b) sole and crown portions engaged with the return portion; (c) a rear body member engaged with the crown and/or sole portions; (d) a weight member at the club head rear; and/or (e) a hosel member engaged with the cup face member, the crown portion, and/or the sole portion.

53 Claims, 10 Drawing Sheets

U.S. PATENT DOCUMENTS

| | | | | |
|---|---|---|---|---|
| 7,025,692 | B2 * | 4/2006 | Erickson et al. | 473/335 |
| 7,163,468 | B2 * | 1/2007 | Gibbs et al. | 473/329 |
| 7,175,541 | B2 | 2/2007 | Lo | |
| 2004/0009829 | A1 | 1/2004 | Kapilow | |
| 2005/0119068 | A1 | 6/2005 | Onoda et al. | |
| 2005/0215350 | A1 | 9/2005 | Reyes et al. | |
| 2006/0000528 | A1 | 1/2006 | Galloway | |
| 2006/0079349 | A1 | 4/2006 | Rae et al. | |
| 2006/0281582 | A1 | 12/2006 | Sugimoto | |
| 2007/0049407 | A1 | 3/2007 | Tateno et al. | |
| 2008/0039228 | A1 | 2/2008 | Breier et al. | |
| 2008/0139339 | A1 | 6/2008 | Cheng | |
| 2009/0075751 | A1 | 3/2009 | Gilbert et al. | |
| 2009/0098949 | A1 | 4/2009 | Chen | |
| 2010/0056298 | A1 | 3/2010 | Jertson et al. | |
| 2011/0118051 | A1 * | 5/2011 | Thomas | 473/328 |

FOREIGN PATENT DOCUMENTS

| | | | |
|---|---|---|---|
| WO | 2006073930 | A3 | 7/2006 |

OTHER PUBLICATIONS

Partial International Search Report in corresponding PCT Application, International Application No. PCT/US2008/067499, mailed Jan. 22, 2009.

International Search Report and Written Opinion issued on May 6, 2011 in related International Application No. PCT/US2011/023968.

Office Action issued in related U.S. Appl. No. 12/700,471, mailed Sep. 8, 2011.

Office Action issued in related U.S. Appl. No. 12/700,471, mailed Jun. 30, 2010.

Office Action issued in related U.S. Appl. No. 12/700,471, mailed Dec. 30, 2010.

International Search Report and Written Opinion in corresponding International Application No. PCT/US2008/067499 dated May 19, 2009.

Apr. 25, 2011 Office Action issued in related Chinese Application No. 200880021522.2; English Translation only.

* cited by examiner

HIGH MOMENT OF INERTIA WOOD-TYPE GOLF CLUBS AND GOLF CLUB HEADS

RELATED APPLICATION DATA

This application claims priority benefits based on U.S. Provisional Patent Appln. No. 61/007,929, filed Jun. 21, 2007. This prior provisional application is entirely incorporated herein by reference.

FIELD OF THE INVENTION

This invention relates generally to golf clubs and golf club heads, including "wood-type" golf clubs and golf club heads, e.g., for drivers, fairway woods, or the like. Additional aspects of this invention relate to methods for making such golf clubs and golf club heads, particularly golf clubs and golf club heads that include a high moment of inertia.

BACKGROUND

Golf is enjoyed by a wide variety of players—players of different genders and dramatically different ages and/or skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with the increased availability of golf programming on television (e.g., golf tournaments, golf news, golf history, and/or other golf programming) and the rise of well known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and in recent years, the industry has witnessed dramatic changes and improvements in golf equipment. For example, a wide range of different golf ball models now are available, with balls designed to complement specific swing speeds and/or other player characteristics or preferences, e.g., with some balls designed to fly farther and/or straighter; some designed to provide higher or flatter trajectories; some designed to provide more spin, control, and/or feel (particularly around the greens); some designed for faster or slower swing speeds; etc. A host of swing and/or teaching aids also are available on the market that promise to help lower one's golf scores.

Being the sole instrument that sets a golf ball in motion during play, golf clubs also have been the subject of much technological research and advancement in recent years. For example, the market has seen dramatic changes and improvements in putter designs, golf club head designs, shafts, and grips in recent years. Additionally, other technological advancements have been made in an effort to better match the various elements and/or characteristics of the golf club and characteristics of a golf ball to a particular user's swing features or characteristics (e.g., club fitting technology, ball launch angle measurement technology, ball spin rates, etc.).

Despite recent technological advances, "wood-type" golf clubs, particularly the driver, can be very difficult for some players to hit consistently well. Accordingly, additional technological advances that improve a player's ability to get a golf ball airborne; increase ball flight distance, direction, and/or control; and/or otherwise improve the playability of wood-type golf clubs, particularly the driver, would be welcome in the golf world.

SUMMARY

The following presents a general summary of aspects of the invention in order to provide a basic understanding of the invention and various features of it. This summary is not intended to limit the scope of the invention in any way, but it simply provides a general overview and context for the more detailed description that follows.

In general, aspects of this invention relate to wood-type golf clubs and/or golf club heads (such as drivers, fairway woods, and the like). Golf club heads and golf clubs in accordance with at least some examples of this invention include club head structures having: (a) a club head body including heel, toe, crown, sole, and rear portions, wherein the rear portion includes at least one increased weight zone; and (b) a variable thickness ball striking face engaged with or integrally formed as part of the club head body (the ball striking face being located remote from one increased weight zone and extending from the club head's toe portion to the heel portion). The club head body parts and increased weight zone(s) in at least some example structures according to this invention will be arranged such that the club head has a moment of inertia about a vertical axis passing through the club head center of gravity when the club head is at a ball address position (also called "Izz" herein) of at least 5000 g-cm$^2$.

Additional example wood-type golf club head structures according to this invention may include one or more of the following: (a) a cup face member including a ball striking face portion (optionally with a variable face thickness) and a return portion; (b) a first body member (e.g., a sole portion) engaged with the return portion; (c) a second body member (e.g., a crown portion) engaged with the return portion; (d) a third body member (e.g., a rear portion) engaged with at least one of the first body member and the second body member, wherein the second body member is located between and separates at least some portion of the third body member from the return portion; (e) one or more weight members engaged or integrally formed with at least one of the first body member and the third body member (located at a rear area of the club head structure); and/or (f) a hosel member engaged with at least one of the cup face member and the second body member. In some club head structures according to the invention, the club head will consist essentially of the parts identified above.

Methods of making golf club head structures in accordance with at least some examples of this invention may include, for example: (a) providing a ball striking face member having a variable ball striking face thickness; (b) engaging a club head body with the ball striking face member, wherein the club head body may be one of the types generally described above. Additional methods of making golf clubs and golf club heads in accordance with at least some examples of this invention may include one or more of the following: (a) forming a cup face member including a ball striking face portion and a return portion extending from a perimeter area of the ball striking face portion; (b) engaging a first body member with the return portion, wherein the first body member includes at least part of a sole portion of the golf club head; (c) engaging a second body member with the return portion, wherein the second body member includes at least part of a crown portion of the golf club head; (d) engaging a third body member with at least one of the first body member and the second body member, wherein the third body member is engaged so as to extend across a portion of a rear area of the golf club head from a heel side toward a toe side of the club head, and wherein the second body member is included in the club head structure so as to be located between at least some portion of the third body member and the return portion; (e) engaging a weight member with at least one of the first body member and the third body member, wherein the weight member is engaged proximate the rear portion of the golf club head; (f) engaging the first body member with the second body member; and/or (g) engaging a hosel member with at least one of the cup face member, the first body member, and/or the second body member.

Such club head structures may be incorporated into an overall golf club structure and/or used as a golf club in any desired manner, including in conventional manners that are known and used in the art.

BRIEF DESCRIPTION OF THE DRAWINGS

A more complete understanding of the present invention and certain advantages thereof may be acquired by referring to the following detailed description in consideration with the accompanying drawings, in which.

Figure 1:
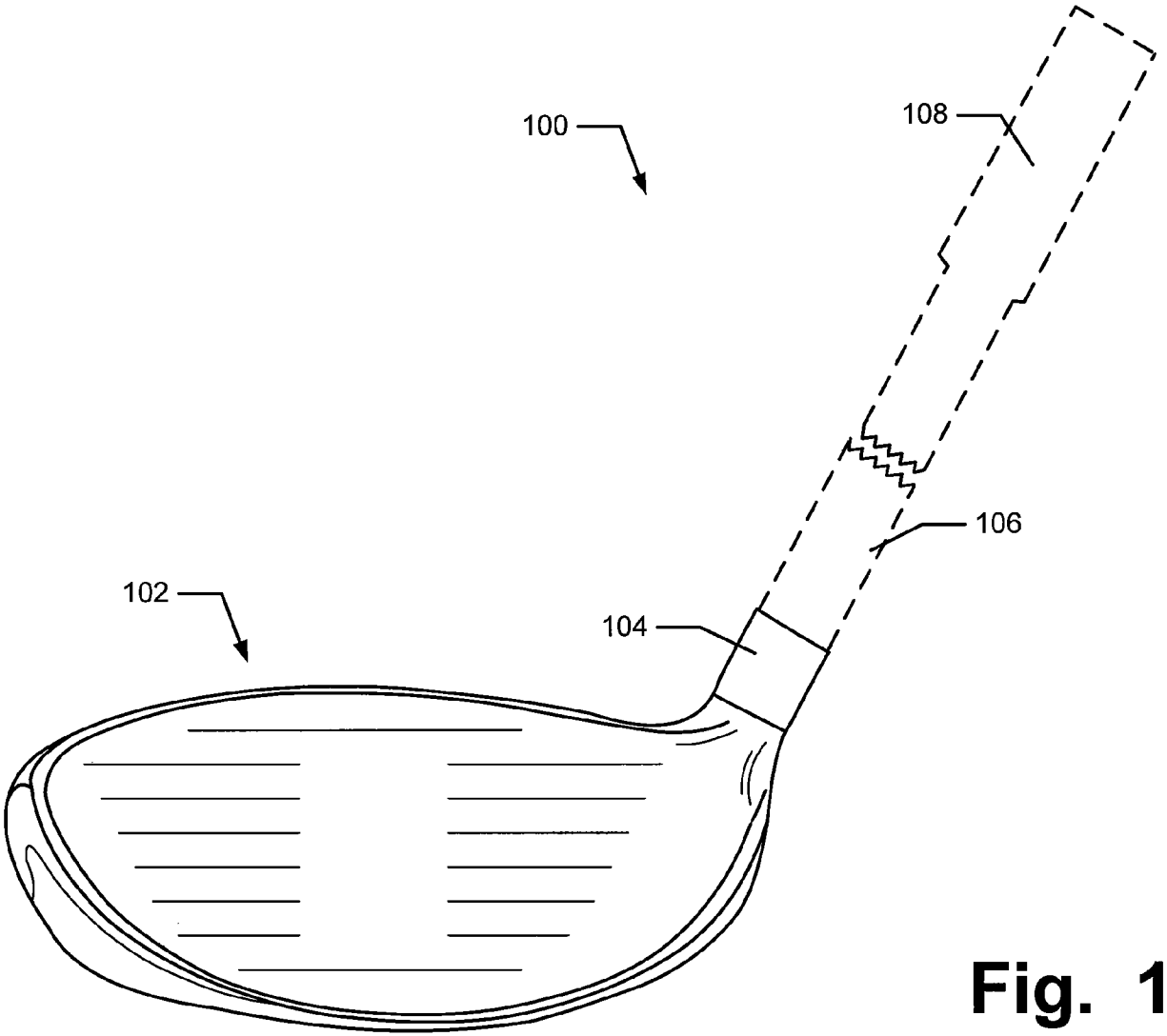
FIG. 1 illustrates a front view of an example golf club according to this invention.

The reader is advised that the attached drawings are not necessarily drawn to scale.

DETAILED DESCRIPTION

In the following description of various example structures in accordance with the invention, reference is made to the accompanying drawings, which form a part hereof, and in which are shown by way of illustration various example golf club heads and golf club structures in accordance with the invention. Additionally, it is to be understood that other specific arrangements of parts and structures may be utilized, and structural and functional modifications may be made without departing from the scope of the present invention. Also, while the terms "top," "bottom," "front," "back," "rear," "side," "underside," "overhead," and the like may be used in this specification to describe various example features and elements of the invention, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of this invention.

A. General Description of Golf Club Heads and Golf Clubs According to Examples of the Invention In general, as described above, aspects of this invention relate to wood-type golf club heads, golf clubs, and the like (such as drivers or fairway woods, and/or the like), as well as to methods of making and using such clubs and club heads. Wood-type golf club heads in accordance with at least some examples of this invention include: (a) a club head body having a heel portion, a toe portion, a crown portion, a sole portion, and a rear portion, wherein the rear portion includes a first increased weight zone; and (b) a variable thickness ball striking face (e.g., a "cup face" arrangement) engaged with or integrally formed as part of the club head body, wherein the ball striking face is located at a portion of the club head body remote from the first increased weight zone and extends from the toe portion to the heel portion. The club head body parts and increased weight zones in at least some example structures according to this invention may be arranged such that the club head has a moment of inertia about a vertical axis passing through the club head center of gravity with the club head at a ball address orientation (also called "Izz" herein) of at least 5000 g-cm$^2$. Furthermore, the club head may have a volume of at least 400 cc, an overall length dimension (in the heel-to-toe direction) of at least 4.5 inches, and a ratio of the overall length dimension to an overall breadth dimension (from front to back) of at least 0.92.

Additional example wood-type golf club head structures according to this invention may include one or more of the following: (a) a cup face member including a ball striking face portion and a return portion extending from a perimeter area of the ball striking face portion; (b) a first body member engaged with the return portion, the first body member including at least part of a sole portion of the golf club head; (c) a second body member engaged with the return portion, the second body member including at least part of a crown portion of the golf club head; (d) a third body member engaged with at least one of the first body member and the second body member, wherein the third body member extends across at least part of a rear portion of the golf club head in a direction from a heel side toward a toe side of the club head, and wherein the second body member is located between and separates at least some portion of the third body member from the return portion; (e) a weight member engaged with at least one of the first body member and the third body member, wherein the weight member is located proximate the rear portion of the golf club head; and/or (f) a hosel member engaged with at least one of the cup face member, the first body member, and/or the second body member. If desired, the first body member may be engaged with the second body member.

The club head body member may be made from a wide variety of materials and parts without departing from this invention, including in conventional ways, from conventional materials and parts, as are known and used in the art. In some more specific examples, parts of the club head may be made from one or more of: metal materials (e.g., metals, such as titanium, magnesium, aluminum, etc.); or metal alloys, such as alloys of steel; alloys containing titanium, magnesium, or aluminum; etc.); composite materials (e.g., carbon fiber composites, basalt fiber composites, etc., for a crown portion, a skirt portion, a sole portion, an aft body portion, a ball striking face portion, etc.); polymeric materials; etc.

The club head body may take on a variety of different forms, shapes, and/or sizes without departing from this invention. For example, the club head may be made as a single piece construction or as a multi-piece construction. Multi-piece constructions also may take on a variety of different forms without departing from this invention, including, for example, multi-piece constructions that include one or more of the following: a ball striking face member (optionally with a ball striking face plate engaged with or integrally formed with a face element (such as a cup face member)); a crown member (e.g., made from a lightweight material, such as carbon fiber or other composite materials, basalt fiber reinforced materials, titanium metal or titanium based alloy materials, etc.); a sole member or a sole plate (e.g., optionally made from a durable, heavier, and/or a relatively dense material (as compared to the crown member), such as a metal or metal alloy material); an aft body member (e.g., including at least some portions of a crown portion, a body ribbon portion or other body portion, and/or a sole portion); a ribbon member); etc. More specific examples of various multi-piece club head constructions in accordance with this invention will be described in more detail below in conjunction with the figures.

If desired, at least some or even all of the club head body and/or the ball striking face of the club head may be made from titanium metal and/or titanium based alloy materials. In some more specific examples, at least 50% of the mass, volume, and/or surface area of the club head body and/or the entire club head will be made from titanium metal and/or titanium based alloy materials, and in some example structures, these amounts may be at least 75%, at least 85%, at least 90%, or even at least 95%. The moment of inertia (Izz) of club head structures in accordance with at least some examples of this invention (as conventionally measured in the art) may be quite high, including, for example: at least 5200 g-cm$^2$, at least 5500 g-cm$^2$, at least 5800 g-cm$^2$, at least 5850 g-cm$^2$, or even at least 5900 g-cm$^2$.

The specific features of club heads in accordance with examples of this invention may vary widely. For example, a club head may have an overall length dimension (in the heel-to-toe direction) of at least 4.75 inches, or even at least 4.8 inches, 4.9 inches or more. The club head volume also may vary, including volumes of at least 420 cc, at least 450 cc, or even 460 cc or more. The ratio of the overall length dimension to an overall breadth dimension of the club head (in the face-to-rear direction) may be at least 0.94, at least 0.96, at least 0.98, or even more.

Golf club heads in accordance with examples of this invention may include still additional features, if desired, including features that are known and used in the golf club art. For example, a weighting system may be permanently mounted to the club head body member, e.g., on an interior or exterior of the club head body, extending from the exterior to the interior of the club head body (e.g., through a weight port), etc. As yet additional examples, if desired, the weighting system may include one or more weight member(s) that are movably and/or removably mounted with respect to the club head body member, e.g., using structures and techniques that are known and used in the art (e.g., by screw, set screw, or other mechanical connector attachments, by sliding attachments, etc.). Advantageously, in accordance with at least some examples of this invention, the weighting system will include weight members located at or proximate to a rear of the club head body member, optionally with weight members provided toward the rear toe, the rear heel, and/or the rear sole portions of the club head. If desired, at least some portions of the weighting system may be selectively movable and/or removable from the club head body member and/or mountable in a variety of different positions and/or arrangements, e.g., to allow customization, interchange, replacement, and/or club-fitting (e.g., to provide a draw biased club, to provide a fade biased club, to provide a high trajectory biased club, to provide a low trajectory biased club, to provide a club to help compensate for undesired ball flights or swing flaws (e.g., to help correct hooks, slices, etc., to help get balls airborne, to help prevent ballooning ball flights, etc.), etc.).

Various features of the club head body part(s) may help reduce or "save" additional weight to enable selective positioning of discretionary weight in the club head structure to increase the club head's moment of inertia and/or otherwise alter its characteristics. For example, the crown portion and/or the sole portion of the club head may include a central area and a perimeter area, wherein the central area is made thinner than the perimeter area. Likewise, the ball striking face may be thinned around its perimeter (to thereby provide the variable thickness ball striking face). The mass "saved" due to the reduced thickness areas of the crown portion, sole portion, and/or ball striking face portion then may be "repositioned" in the club head structure to increase the moment of inertia of the club head, to affect ball flight characteristics (e.g., to bias the club for certain desired types of ball flights, as mentioned above), and/or to help compensate for user swing flaws.

Additional aspects of this invention relate to golf club structures that include golf club heads, e.g., of the types described above (such as wood-type golf clubs including drivers, fairway woods, wood-type hybrid or utility clubs, etc.). In addition to club head structures of the types described above, golf clubs according to at least some examples of this invention may include one or more of: (a) a shaft member engaged with the club head body (e.g., with the face member, one or more of the body members, or both); (b) a grip member engaged with the shaft, and/or (c) a handle member engaged with the club head and/or the shaft. These additional elements of the golf club structure may be included in the overall club structure in any desired manner without departing from this invention, including in conventional manners that are known and used in the art (e.g., the shaft may be engaged via an external hosel member, via an internal hosel member, through an opening provided in the club head, via adhesives, via mechanical connectors (e.g., threads, retaining elements, etc.), etc.). Additionally, these additional elements of the golf club structure may be made from conventional materials, in conventional constructions and/or manners, e.g., as are known and used in the art. If desired, one or both of the club head face member and/or the body member(s) may be formed to include a hosel element, or if desired, a hosel element of some type may be engaged with one or more of the face member and/or the body member(s) (e.g., interior, exterior, or both, with respect to the overall club head structure).

B. General Description of Example Methods of Making and/or Using Golf Club Heads and Golf Clubs According to the Invention Additional aspects of this invention relate to methods of making golf club heads and/or golf club structures in accordance with this invention (e.g., of the various types described above). Such methods may include, for example, one or more of the following steps: (a) providing a ball striking face having a variable ball striking face thickness; (b) engaging a club head body with the ball striking face, wherein the club head body includes a heel portion, a toe portion, a crown portion, a sole portion, and a rear portion; wherein the rear portion includes a first increased weight zone; wherein the ball striking face is located at a portion of the club head body remote from the first increased weight zone and extends at least partially in a direction from the toe portion toward the heel portion; wherein the club head has a moment of inertia Izz of at least 5000 g-cm$^2$; wherein the club head has a volume of at least 400 cc; wherein the club head has an overall length dimension (in the heel-to-toe direction) of at least 4.5 inches; and wherein the club head has a ratio of the overall length dimension to an overall breadth dimension (in the face-to-rear direction) of at least 0.92; (c) engaging a shaft member with the golf club head; and/or (d) engaging a grip member with the shaft member. Such golf clubs and golf club heads may have any of the desired characteristics described in the subsection above.

Additional methods of making golf clubs and golf club heads in accordance with at least some examples of this invention may include one or more of the following: (a) forming a cup face member including a ball striking face portion and a return portion extending from a perimeter area of the ball striking face portion; (b) engaging a first body member with the return portion, wherein the first body member includes at least part of a sole portion of the golf club head; (c) engaging a second body member with the return portion, wherein the second body member includes at least part of a crown portion of the golf club head; (d) engaging a third body member with at least one of the first body member and the second body member, wherein the third body member is engaged so as to extend across at least part of a rear portion of the golf club head in a direction from a heel side toward a toe side of the club head, and wherein the second body member is engaged so as to be located between at least some portion of the third body member and the return portion; (e) engaging a weight member with at least one of the first body member and the third body member, wherein the weight member is engaged proximate the rear portion of the golf club head; (f) engaging the first body member with the second body member; (g) engaging a hosel member with at least one of the cup face member, the first body member, and/or the second body member; (h) engaging a shaft member with the golf club head; and/or (i) engaging a grip member with the shaft member. Again, such golf clubs and golf club heads may have any of the desired characteristics described above.

As noted above, various individual parts of the club head body and/or the ball striking face may be made with different thicknesses (e.g., a thicker center portion for the ball striking face, a thicker perimeter portion for the crown and/or sole members, etc.). This change in thickness may be accomplished in any desired manner without departing from this invention. In some more specific examples, various desired portions of the club head body and/or the ball striking face may be made thinner by milling or machining processes, including chemical milling processes.

The various parts of the golf club and the club head may be engaged together in any desired manner. As some more specific examples, the various "engaging" steps described above may include one or more of: bonding using adhesives or cements; engaging using welding, brazing, soldering, or other fusing techniques; attachment using mechanical connectors (such as screws, bolts, nuts, or the like); and the like. If desired, in some more specific example structures according to this invention, the various parts of the club head structure may be welded together.

Golf clubs according to at least some examples of this invention may be produced by engaging a shaft member and/or a handle member with the club head body (e.g., of the types described above). This may be accomplished in any desired manner, including in conventional manners that are well known and used in the art (e.g., via cements or adhesives, via mechanical connectors, etc.). Additionally, if desired, a grip element may be engaged with the shaft or handle member, e.g., in any desired manner, including in conventional manners that are well known and used in the art (e.g., via cements or adhesives, via mechanical connectors, etc.). Golf club heads and golf clubs in accordance with this invention may be used in conventional ways as also are known in the art.

Specific examples of the invention are described in more detail below. The reader should understand that these specific examples are set forth merely to illustrate examples of the invention, and they should not be construed as limiting the invention.

C. Specific Examples of the Invention

FIG. 1 generally illustrates an example wood-type golf club 100 in accordance with at least some examples of this invention. As is conventional, the club 100 includes a club head 102, a hosel region 104 that connects the club head to a shaft 106, and a grip member 108 engaged with the shaft 106. Various example features and aspects of the club head structure 102 will be described in more detail below in conjunction with the remaining figures. The club head 102 may be engaged with the shaft 106 via a hosel element 104 in any desired manner, including in manners that are known and used in the art (e.g., via cements or adhesives, via mechanical connections, via releasable mechanical connections, via welding, soldering, brazing, or other fusing techniques, etc.). Any desired material may be used for the shaft member 106, including conventional materials that are known and used in the art, such as steel, graphite, polymers, composite materials, combinations of these materials, etc. Likewise, the grip member 108 may be engaged with the shaft 106 in any desired manner, including in manners that are known and used in the art (e.g., via cements or adhesives, via mechanical connections, via releasable mechanical connections, etc.). Any desired material may be used for the grip member 108, including conventional materials that are known and used in the art, such as rubber, polymeric materials, cork, rubber or polymeric materials with cord or other fabric elements embedded therein, cloth or fabric, tape, etc.

Figure 2A:
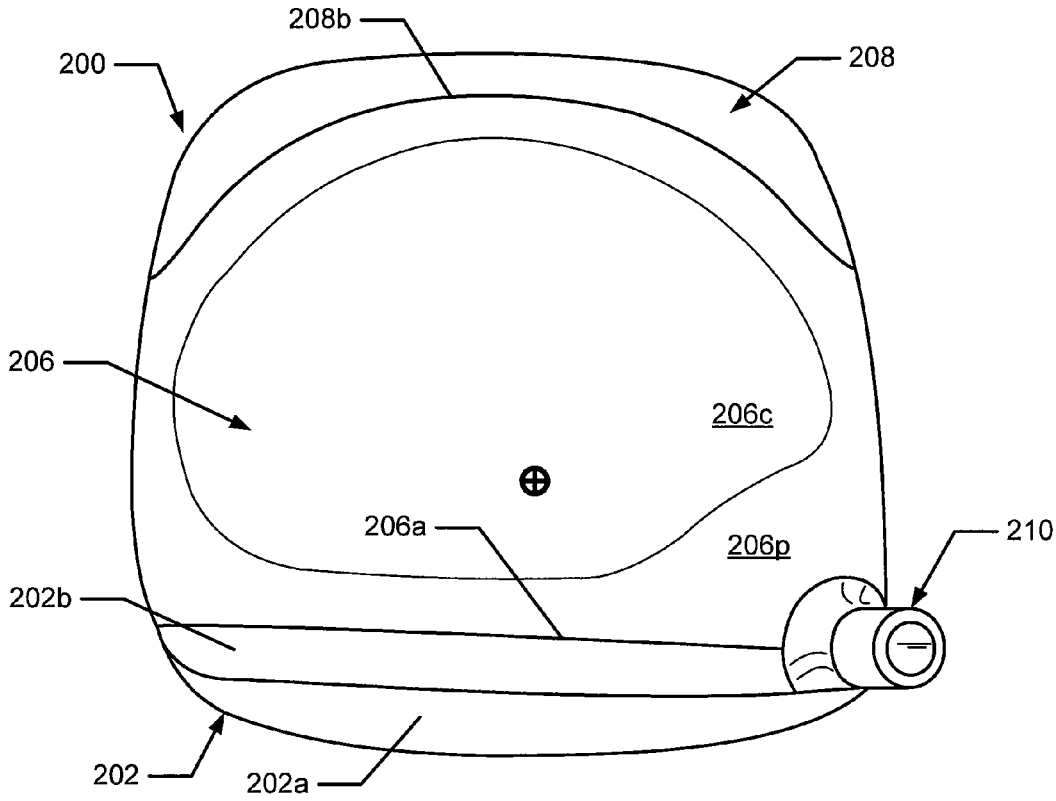
FIGS. 2A through 2G illustrate various views of a golf club head and its face member in accordance with one example of this invention.
Figure 2B:
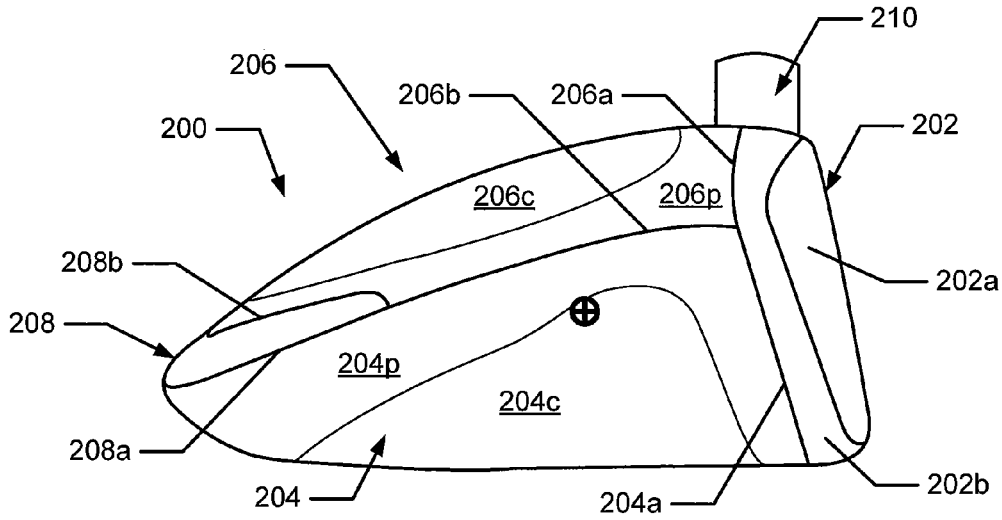

Constructions of golf club heads in accordance with examples of this invention now will be described in more detail in conjunction with FIGS. 2A through 6. One example club head structure 200 and portions thereof are illustrated in FIGS. 2A through 2G. FIGS. 2A and 2B generally illustrate this example club head structure 200 as having a relatively square or rectangular footprint as viewed looking downward at the crown, e.g., from a ball address position. The rectangular or "squareness" characteristics of this club head 200 (and all other rectangular shaped club heads described herein) may correspond to the characteristics of other generally rectangular or square shaped golf club head structures as are known in the art, such as the characteristics described in U.S. patent application Ser. No. 11/425,737, filed Jun. 22, 2006 in the name of John T. Stites, et al. (entitled "Golf Clubs and Golf Club Heads"), which application is entirely incorporated herein by reference.

The club head 200 of this example structure has a multipart construction. Specifically, this example club head structure 200 includes a cup face member 202 that has a ball striking face portion 202*a* and a return portion 202*b* extending around and rearward from a perimeter of the ball striking face portion 202*a*. While illustrated as continuous and extending from the complete perimeter of the ball striking face portion 202*a*, the return member 202*b* may be discontinuous, stepped, and/or extend different distances from various areas of the perimeter of the ball striking face portion 202*a*.

While the cup face member 202 may be made from various materials, in this specific example structure 200 the cup face member 202 is formed from a titanium alloy that is conventionally known and used in the art, and it is produced as a single piece by a forging process. Additional details of example cup face member structures 202 will be provided below. Other structures or manufacturing techniques are possible, however, without departing from the invention, such as making the face member 202 from multiple parts that are joined together, e.g., by welding or the like.

The club head 200 further includes a sole member 204 engaged with a lower portion of the return member 202*b* of the cup face member 202. In this example structure 200, the sole member 204 is a single part that forms all or substantially all of the bottom portion of the club head 200, from the face member 202 to the very rear of the club head 200. If desired, however, the sole member 204 may be made from multiple pieces that are joined together, e.g., via cements or adhesives, via mechanical connections, via releasable mechanical connections, via welding, soldering, brazing, or other fusing techniques, etc. In this illustrated example structure 200, the sole member 204 is a single titanium alloy part (e.g., a conventional alloy as is known and used in the art), made by a pressing procedure. The sole member 204 is engaged with the return portion 202*b* of the cup face 202 along seam 204*a* by a welding process. If desired, the sole member 204 further may include rib members, bends, or raised areas (internally or externally), textual information, etc., e.g., to increase its stiffness, to provide desired aesthetics or information, etc.

A crown member 206 further is provided as part of this example club head structure 200. The crown member 206 is engaged with an upper portion of the return member 202*b* of the cup face member 202. In this example structure 200, the crown member 206 forms a substantial portion of the club head top, from the face member 202 to a location near the rear of the club head 200. If desired, the crown member 206 may be made from multiple pieces that are joined together, e.g., via cements or adhesives, via mechanical connections, via releasable mechanical connections, via welding, soldering, brazing, or other fusing techniques, etc. In this illustrated example structure 200, the crown member 206, like the sole member 204, is a single titanium alloy part, made by a pressing procedure, that is engaged with the return portion 202*b* of the cup face 202 at seam 206*a* by a welding process. If desired, the crown member 206 further may include rib members, bends, or raised areas (internally or externally), textual information, e.g., to increase its stiffness, to provide desired aesthetics or information, etc.

Figure 2C:
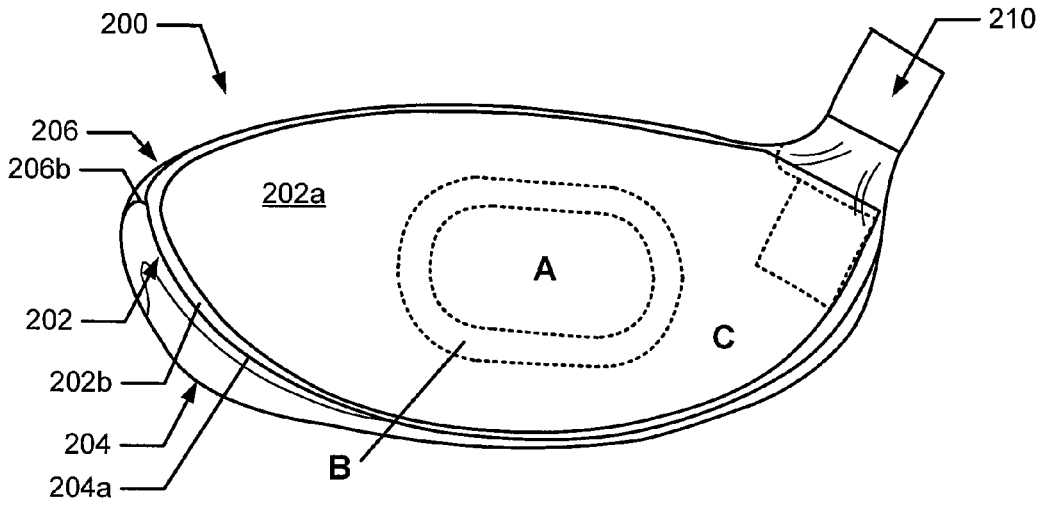
Figure 2D:
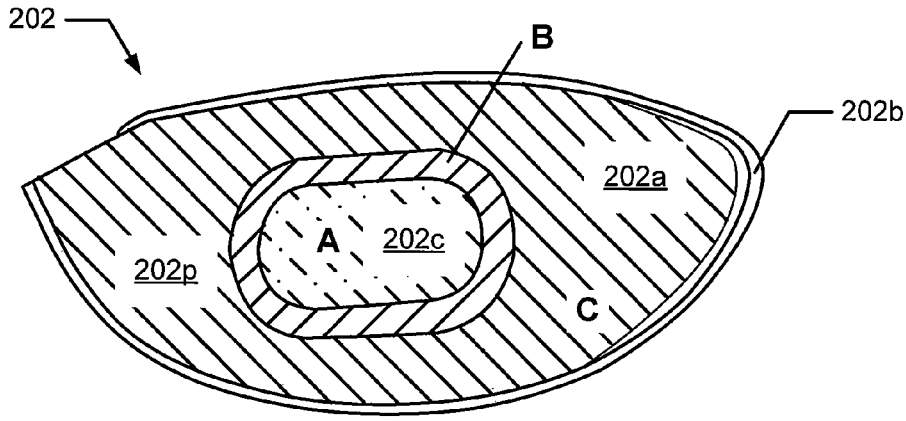
Figure 2G:
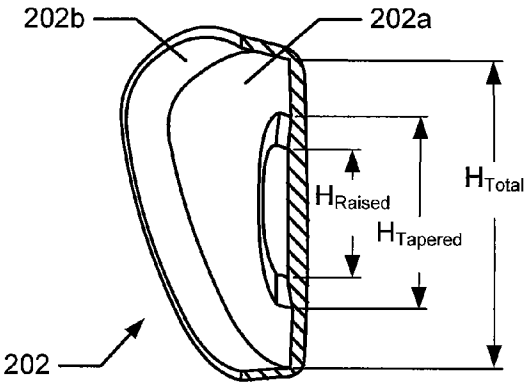
Figure 2E:
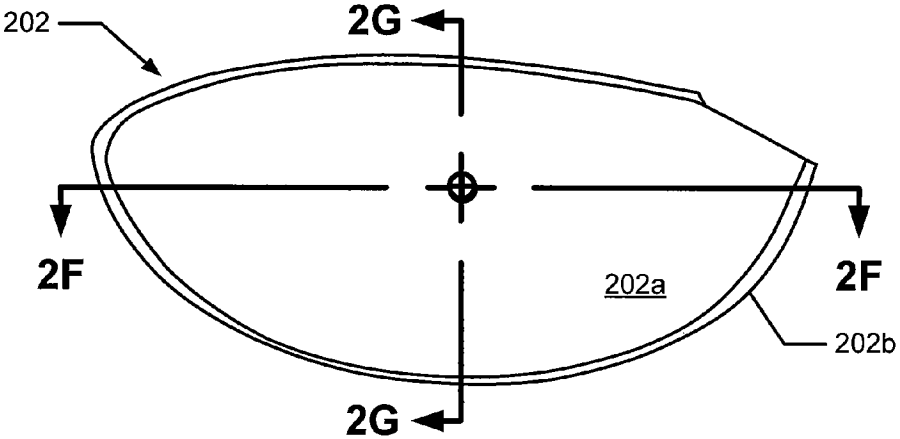
Figure 2F:
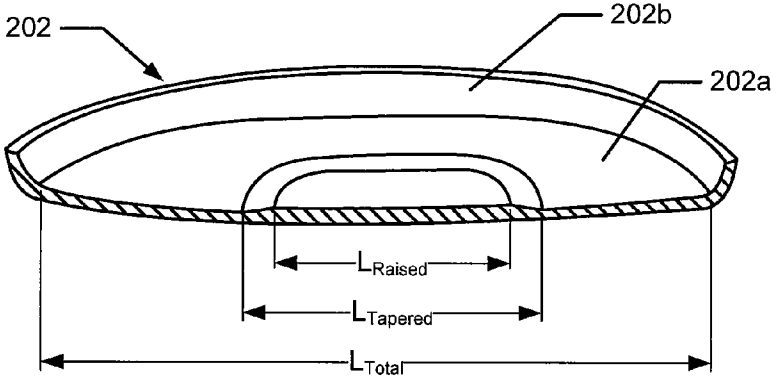

The crown member 206 and the sole member 204 of this club head structure 200 also may be engaged with one another, along seam 206*b*, as shown in FIGS. 2B and 2C. This may be accomplished in any desired manner without departing from the invention, such as via cements or adhesives, via mechanical connections, via releasable mechanical connections, via welding, soldering, brazing, or other fusing techniques, etc. In this illustrated example structure 200, the crown member 206 and the sole member 204 are engaged with one another at seam 206*b* by a welding process.

FIGS. 2A and 2B illustrate another part of this example club head structure 200, namely, the rear body member 208. The rear body member 208 of this structure 200 is engaged with the sole member 204 and the crown member 206 (at seams 208*a* and 208*b*, respectively) via a welding connection. Other connection types may be used, if desired, without departing from this invention, including, for example, cements or adhesives; mechanical connections; releasable mechanical connections; soldering, brazing, or other fusing techniques; etc. The rear body member 208 of this structure, which may be made from titanium metal or a titanium based alloy material, may be used to provide increased weight regions at the rear and/or extreme "corners" (or other desired positions) of the club head structure 200. Any desired way of increasing the weight of or the weight engaged with the rear body member 208 may be used without departing from this invention, including using a denser or thicker material as at least part of the rear body member 208, engaging a weight member with the rear body member 208 (e.g., permanently or removably), and the like. Additionally or alternatively, if desired, increased weight regions may be provided at the extreme rear and/or corner portions of the sole member 204. Various examples of weighting structures and/or weighting locations will be described in more detail below in conjunction with FIGS. 3A through 3C.

Another individual part of this example club head structure 200 is illustrated in FIGS. 2A through 2C, namely, a hosel member 210 for receiving a shaft member (shaft not illustrated in FIGS. 2A through 2C). The hosel member 210 in this example structure 200 is a separate part that is engaged with one or more of the cup face member 202 or the crown member 206. Additionally or alternatively, if desired, the hosel member 210 may be engaged with the sole member 204 without departing from this invention. The hosel member 210 may take on any desired form or construction without departing from this invention. For example, some or all portions of the hosel member 210 may be located internal to the club head structure 200 (e.g., within a hollow chamber defined at least in part by members 202-208). As another alternative, the hosel member 210 may be omitted, e.g., if the crown member 206 and/or the cup face member 202 include structures for securing a shaft member. In this illustrated example, the hosel member 210 is made from titanium metal or a titanium alloy material, and it is engaged with the crown member 206 and the cup face member 202 by welding processes (although other connection arrangements may be used, if desired, such as cements or adhesives; mechanical connections; releasable mechanical connections; soldering, brazing, or other fusing techniques; etc.).

Weighting characteristics can be important to providing a wood-type golf club head with desired user feel and swing characteristics, such as overall weight, moment of inertia, etc. By making some or all of the club head parts from titanium metal and/or titanium based alloys, a relatively strong and lightweight club head structure can be provided (other lightweight materials also may be used without departing from this invention, such as aluminum, aluminum alloys, magnesium, magnesium alloys, polymeric materials, reinforced carbon fiber materials, reinforced basalt fiber materials, etc.). Making the club head body parts from lightweight materials allows club designers to selectively place additional weight at desired locations in the club head structure without creating an excessively heavy golf club structure, which can lead to increased club head moment of inertia characteristics, selective club head biasing characteristics (to bias the club head to produce a right-to-left ball flight, a left-to-right ball flight, a lower trajectory, a higher trajectory, etc.), and the like. Such features also allow club head designers and club fitters to selectively place weight in the club head so as to help compensate for user swing flaws (e.g., to "draw" or "hook" bias a club head to help compensate for swing flaws that produce a slice, to "fade" or "slice" bias a club head to help compensate for swing flaws that produce a hook, etc.).

In addition to the use of the lightweight materials, golf club head structures 200 according to this invention may include other features that help reduce the weight of its parts (e.g., members 202-206). For example, FIG. 2B illustrates that the sole member 204 includes a thicker perimeter portion 204*p* that surrounds a thinner central portion 204*c*. Likewise, FIGS. 2A and 2B illustrate that the crown member 206 includes a thicker perimeter portion 206*p* that surrounds a thinner central portion 206*c*. In this manner, the overall weight of the sole member 204 and crown member 206 can be reduced (as compared to making the entire part of the same thickness as its perimeter portion) while still providing relatively thick, strong areas around the perimeters of these parts for connecting the various parts of the club head 200 together. This "weight savings" then can be selectively "repositioned" in the club head structure at other locations, as noted above. While FIGS. 2A and 2B illustrate the club head body parts 204 and 206 each as having a single thinner central region surrounded by a single and continuous (and thicker) perimeter region, the number, relative sizes, locations, dimensions, and other features of the various thick and thin regions of a club head body part may be varied without departing from this invention.

Any desired manner of reducing the thickness of the central (or other) portions of the sole and/or crown members may be used without departing from this invention. For example, the parts may be directly created in this manner, e.g., by forging, casting, or molding processes. As another example, a part may be "machined" after its initial creation to make one part of the member (e.g., the central portion) thinner than another part of the same member (e.g., the perimeter part). Any desired manner of "machining" the various members may be used without departing from this invention, including grinding, sanding, or the like. In some club head production processes, a "chemical milling" procedure will be used in which an acid material is selectively applied to the part at the desired location(s) to be thinned to thereby remove some portion of the metal or alloy (or other) material of the part at those locations. Such chemical milling procedures are conventionally known and used in various industries.

Weight savings also may be realized, in accordance with at least some example structures according to this invention, by using a variable face thickness on the ball striking face 202*a* of the club head 200. In this illustrated example, as shown in FIGS. 2C through 2G, the ball striking face 202*a* is made thicker in the central area 202*c* (region "A" in the drawings, where ball strikes typically occur) and thinner around this central area 202*c* and around the perimeter (area 202*p*) (region "C" in the drawings). A transition region located on the interior of the club head (opposite the ball striking face surface—region "B" in the drawings) gradually slopes or otherwise transitions the face thickness between the thicker central region 202*c* and the thinner perimeter region 202*p*. The variable face thickness may be advantageous in that it provides a thick, strong face at the location of typical ball strikes while providing a relatively thin and/or flexible perimeter (to increase the club head's coefficient of restitution or "COR"). Club heads in accordance with examples of this invention may have any desired COR value, including at least 0.75, at least 0.8, at least 0.81, at least 0.82, at least 0.83, or even higher. Also, while FIGS. 2C through 2G illustrate a single thicker face portion 202*c* on the ball striking face 202*a* (substantially centrally located on the ball striking face 202*a* (surrounded by a single, continuous, thinner perimeter region)), the number, relative sizes, locations, dimensions, and other features of the various thick and thin regions of a ball striking face 202*a* may be varied without departing from this invention.

Figure 3A:
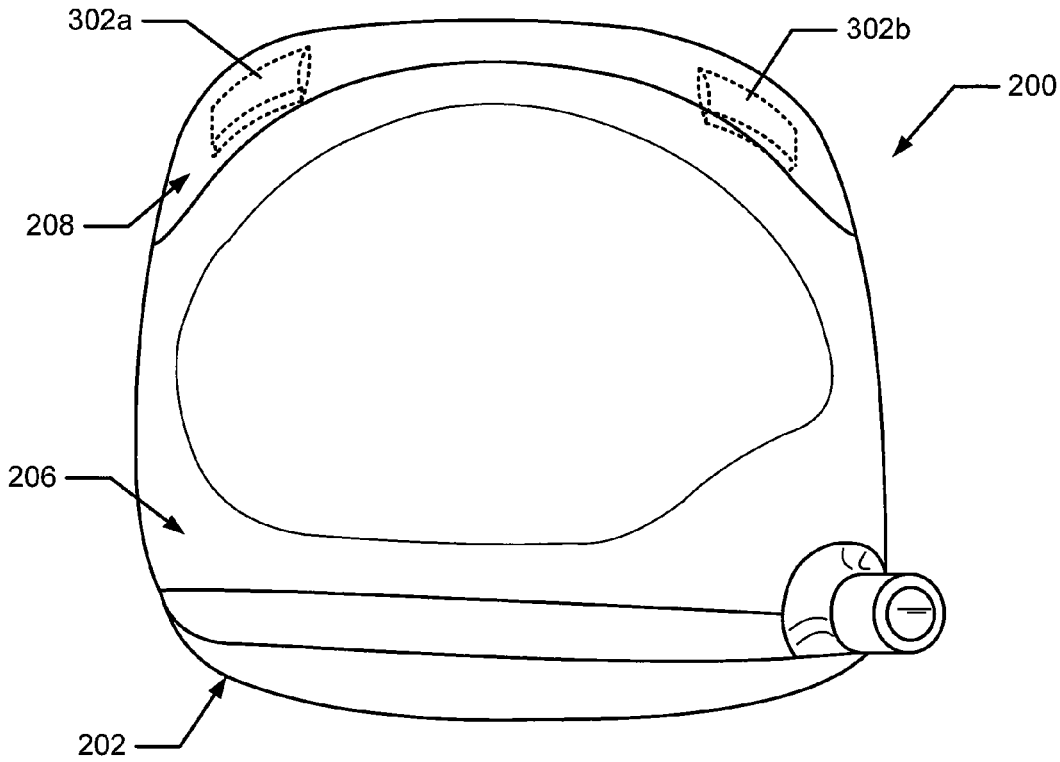
FIGS. 3A through 3C illustrate various views of example another golf club head structure in accordance with this invention.
Figure 3B:
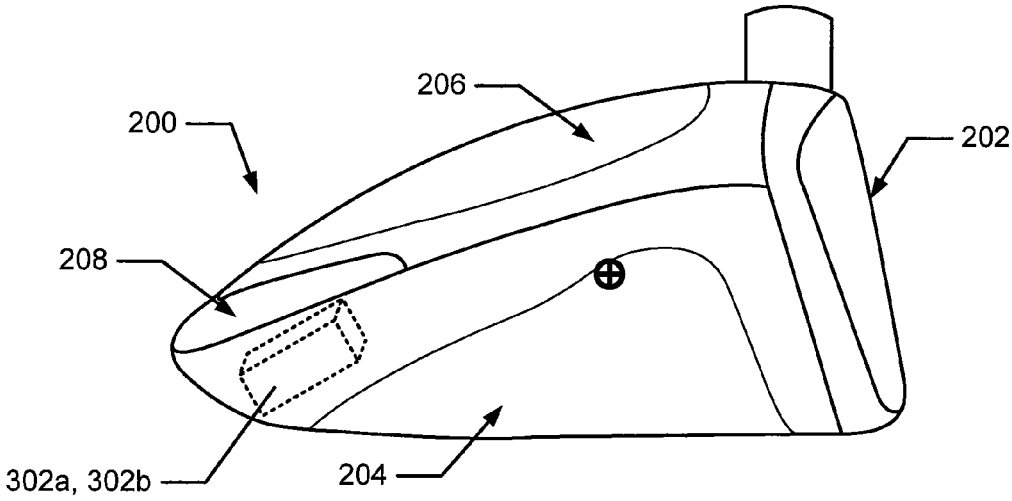
Figure 3C:
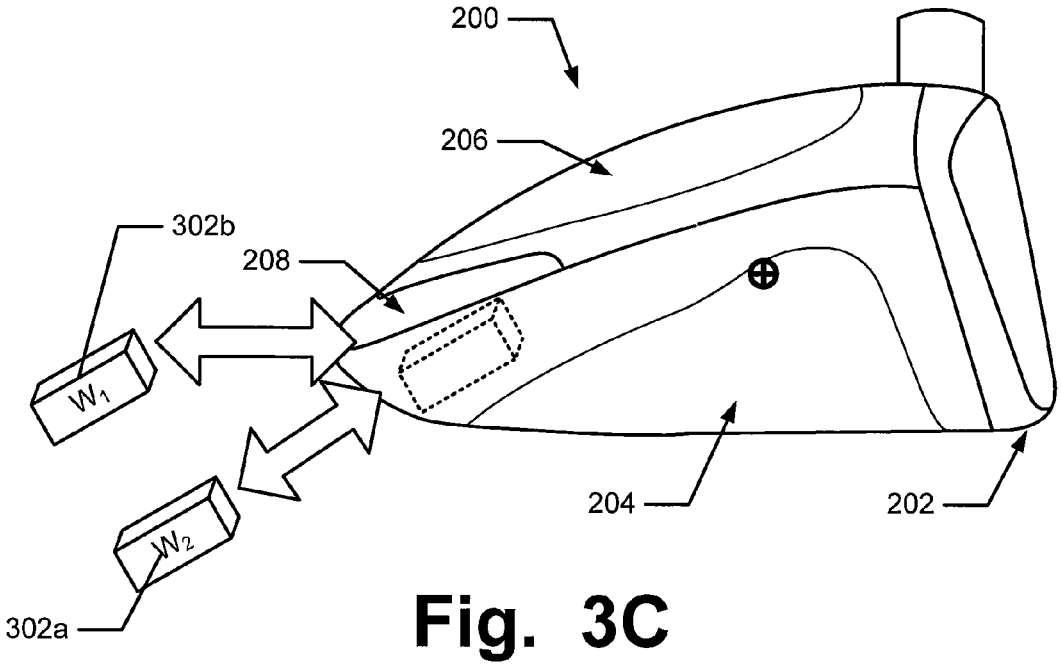

FIGS. 3A through 3C illustrate one example of weight arrangement in a golf club head structure, like the structure 200 described above in conjunction with FIGS. 2A through 2G. FIGS. 3A through 3C illustrate the club head 200 of FIGS. 2A through 2G with weight members 302*a* and 302*b* provided at the extreme outermost rear/corner areas of the club head structure 200. The weight member(s) (e.g., 302*a* and 302*b*) may be included as part of the club head structure 200 in any desired manner without departing from this invention. For example, they may be integrally formed as part of one of the body parts of the club head 200 (e.g., the sole member 204 or the rear member 208), or they may be engaged with one or more of these body parts (e.g., using adhesives or cements, mechanical connections, welding or other fusing techniques, etc.). FIGS. 3A and 3B illustrate weight members 302*a* and 302*b* permanently included as part of an interior of the club head structure 200. FIG. 3C, on the other hand, illustrates weight members 302*a* and 302*b* that may be removable from and separately and selectively engageable on one or more externally accessible ports provided in the club head structure 200 (e.g., via a threadable connection, akin to removable weights included in various known and commercially available golf club structures). The weights 302*a*/302*b* may be the same or different from one another, including having the same or different sizes, shapes, masses, club head engagement structures, and/or removable club head connection structures. Also, any desired number of weights and/or weight receiving ports may be provided on a club head structure 200 without departing from this invention.

The following Table provides various characteristics that may be included in golf club head structures like structures 200 described above in conjunction with FIGS. 1 through 3C:

TABLE 1

Various Club Head Characteristics - General Ranges

| Club Head Characteristic | Range of Values |
|---|---|
| Length (Maximum Heel to Toe Dimension) | 4 to 6 inches |
| Breadth (Maximum Front to Back Dimension) | 4 to 6 inches |
| Height (Maximum Sole to Crown Dimension) | 1 to 3.5 inches |
| Volume (Club Head) | At Least 380 cc |
| Loft Angle | 5 to 20° |
| Coefficient of Restitution | At Least 0.75 |
| Moment of Inertia - Izz | at least 5000 g-cm$^2$ |
| Weight | 170 to 250 g |

Some club head structures in accordance with examples of this invention will have characteristics as described in the following Table:

TABLE 2

Various Club Head Characteristics - Ranges of Values

| Club Head Characteristic | Range of Values |
|---|---|
| Length (Maximum Heel to Toe Dimension) | 4.5 to 5.5 inches |
| Breadth (Maximum Front to Back Dimension) | 4.5 to 5.5 inches |
| Height (Maximum Sole to Crown Dimension) | 1.25 to 3 inches |
| Volume (Club Head) | At Least 400 cc |
| Loft Angle | 7.5 to 16° |
| Coefficient of Restitution | At Least 0.8 |
| Moment of Inertia - Izz | at least 5200 g-cm$^2$ |
| Weight | 180 to 240 g |

Even more narrow ranges of characteristics of club head structures in accordance with at least some examples of this invention are provided in the following Table:

TABLE 3

Various Club Head Characteristics - Ranges of Values

| Club Head Characteristic | Range of Values |
|---|---|
| Length (Maximum Heel to Toe Dimension) | 4.5 to 5 inches |
| Breadth (Maximum Front to Back Dimension) | 4.5 to 5 inches |
| Height (Maximum Sole to Crown Dimension) | 1.5 to 2.5 inches |

TABLE 3-continued

| Various Club Head Characteristics - Ranges of Values | |
|---|---|
| Club Head Characteristic | Range of Values |
| Volume (Club Head) | At Least 420 cc |
| Loft Angle | 7.5 to 13.5° |
| Coefficient of Restitution | At Least 0.82 |
| Moment of Inertia - Izz | at least 5500 g-cm$^2$ |
| Weight | 185 to 230 g |

If desired, club heads in accordance with at least some examples of this invention may approach the maximum dimensions, maximum volume, and maximum COR characteristics currently allowed by the Rules of Golf as set forth by the United States Golf Association.

As mentioned above, however, other features of golf club head structures, e.g., like structure 200 illustrated in FIGS. 2A through 3C, may help provide the desirable weighting and/or moment of inertia characteristics. The following Table describes various additional features of a golf club head and its various parts, like those illustrated in FIGS. 2A through 3C, that may be used to produce a high moment of inertia club head:

TABLE 4

| One Example Club Head Structure | | | |
|---|---|---|---|
| Body Part (From FIGS. 2A through 3C) | Material | Thickness | Weight |
| 202p (Face Perimeter) | Ti-Alloy | 2.35 mm | Total Weight of Ball Striking Face 202a: 53.7 grams |
| 202c (Face Center) | Ti-Alloy | 3.25 mm | |
| 202b (Return Portion) | Ti-Alloy | 1.5 mm | 13.0 grams |
| 204c (Sole Center) | Ti-Alloy | 0.6 mm | 22.6 grams |
| 204p (Sole Perimeter) | Ti-Alloy | 0.95 mm | 28.1 grams |
| 206c (Crown Center) | Ti-Alloy | 0.55 mm | 17.4 grams |
| 206p (Crown Perimeter) | Ti-Alloy | 0.8 mm | 15.5 grams |
| 208 (Rear Member) | Titanium Metal | 2.5 mm | 18.2 grams |
| 210 (Hosel) | Ti-Alloy | | 17.6 grams |
| 302a (Toe Side Weight) | Ti-Alloy | | 7.5 grams |
| 302b (Heel Side Weight) | Ti-Alloy | | 3.5 grams |
| Additional Weight (if necessary)* | Fluid/Gel Material (e.g., Glue, etc.) | | 2.0 grams |

*A material that may be injected into the club head toward the end of manufacturing (e.g., through the hosel opening), if necessary, to adjust the final weight of the club head and/or its center of gravity characteristics.

Large size golf club heads in accordance with examples of this invention, e.g., of the type illustrated in FIGS. 2A through 3C and described in the tables above, may have moment of inertia (Izz) characteristics of at least 5700 g-cm$^2$. Specific club head structures may have Izz values of at least 5800 g-cm$^2$, at least 5850 g-cm$^2$, and even at least 5900 g-cm$^2$. Such club heads may have overall dimensional sizes approaching the USGA maximum limits (e.g., an overall length and breadth of at least 4.5 inches and an overall volume of at least 450 cc, and in some examples, length dimensions of at least 4.75 inches and volumes of about 460 cc). Such club heads may have dimensions, for example, similar to the overall dimensions of commercially available Sumo Squared™ golf club products available from NIKE, Inc. of Beaverton, Oreg.

As illustrated in FIGS. 2C through 2G, the ball striking face 202*a* includes a thicker central portion 202*c* (region "A") and a thinner perimeter portion 202*p* (region "C"). These thicker and thinner portions may have a wide variety of shapes, sizes, locations (with respect to the club head face) and thickness differentials without departing from this invention. For example, the specific dimensions for the thicker portion A, the tapered portion (region "B"), and the overall club head structure in FIGS. 2F and 2G may be as follows:

TABLE 5

| Variable Face Thickness Characteristics | | | |
|---|---|---|---|
| Dimension | General Range | Additional Range | Additional Range |
| $L_{Raised}$ | 20-80 mm | 25-75 mm | 32-72 mm |
| $L_{Tapered}$ | 35-100 mm | 40-95 mm | 45-85 mm |
| $L_{Total}$ | 75-130 mm | 80-125 mm | 90-115 mm |
| $H_{Raised}$ | 10-35 mm | 12-30 mm | 15-25 mm |
| $H_{Tapered}$ | 15-50 mm | 20-45 mm | 25-40 mm |
| $H_{Total}$ | 30-70 mm | 35-65 mm | 40-60 mm |

The specific example club head structure of Table 4 and FIGS. 2A through 2G may have dimensional values as follows:

TABLE 6

| Specific Face Size Characteristics | |
|---|---|
| Dimension | Value |
| $L_{Raised}$ | 37 mm |
| $L_{Tapered}$ | 48 mm |
| $L_{Total}$ | 102 mm |
| $H_{Raised}$ | 21 mm |
| $H_{Tapered}$ | 31 mm |
| $H_{Total}$ | 49 mm |
| Area of Region A | 710 mm$^2$ |
| Area of Region B | 581 mm$^2$ |
| Area of Region C | 3280 mm$^2$ |

Such a club head, having the characteristics described and illustrated in conjunction with Tables 3, 4, and 6 and FIGS. 2A through 2G, may have a moment of inertia Izz of about 5900 g-cm$^2$ or higher. Of course, rather than a tapered change in the ball striking face thickness (region B), the change may be smoothly contoured, stepped, abrupt, or otherwise without departing from this invention.

FIGS. 4A through 4G illustrate another example club head structure 400 in accordance with this invention. This example structure 400 is similar to that of FIGS. 2A through 2G (and therefore will be labeled with similar reference numbers for similar parts), with a few noteworthy exceptions. For example, this example golf club head structure 400 includes a single weight member 412 mounted in the rear toe corner area of the club head structure 400.

The specific weighting and thickness characteristics of this golf club head structure 400 also differ somewhat from those described for the example golf club head structures illustrated in FIGS. 2A through 2G. The following Table describes various features of a golf club head, like that illustrated in FIGS. 4A through 4G, that may be used to produce a high moment of inertia club head:

TABLE 7

| Another Example Club Head Structure | | | |
|---|---|---|---|
| Body Part (From FIGS. 4A through 4G) | Material | Thickness | Weight |
| 402p (Face Perimeter) | Ti-Alloy | 2.15 mm | Total Weight of Ball Striking Face 402a: 52.4 grams |
| 402c (Face Center) | Ti-Alloy | 3.05 mm | |

TABLE 7-continued

| Another Example Club Head Structure | | | |
|---|---|---|---|
| Body Part (From FIGS. 4A through 4G) | Material | Thickness | Weight |
| 402b (Return Portion) | Ti-Alloy | 1.5 mm | 13.6 grams |
| 404c (Sole Center) | Ti-Alloy | 0.6 mm | 23.8 grams |
| 404p (Sole Perimeter) | Ti-Alloy | 0.95 mm | 24.6 grams |
| 406c (Crown Center) | Ti-Alloy | 0.55 mm | 17.3 grams |
| 406p (Crown Perimeter) | Ti-Alloy | 0.8 mm | 13.7 grams |
| 408 (Rear Member) | Ti-Alloy | 1.5 mm | 16.1 grams |
| 410 (Hosel) | Ti Metal | | 15.7 grams |
| 412 (Toe Side Weight) | Ti Metal | | 18.9 grams |
| Additional Weight (if necessary)* | Fluid/Gel Material (e.g., Glue, etc.) | | 2.0 grams |

*A material that may be injected into the club head toward the end of manufacturing (e.g., through the hosel opening), if necessary, to adjust the final weight of the club head and/or its center of gravity characteristics.

The club head 400 of FIGS. 4A through 4G also differs from the club head structure 200 of FIGS. 2A through 2G in its variable ball striking face thickness properties. The specific example club head structure of Table 7 and FIGS. 4A through 4G may have dimensional values as follows:

TABLE 8

| Specific Face Size Characteristics | |
|---|---|
| Dimension | Value |
| $L_{Raised}$ | 66 mm |
| $L_{Tapered}$ | 79 mm |
| $L_{Total}$ | 102 mm |
| $H_{Raised}$ | 22 mm |
| $H_{Tapered}$ | 34 mm |
| $H_{Total}$ | 49 mm |
| Area of Region A | 1243 $mm^2$ |
| Area of Region B | 1049 $mm^2$ |
| Area of Region C | 2209 $mm^2$ |

Such a club head, having the characteristics described and illustrated in conjunction with Tables 7 and 8 and FIGS. 4A through 4G, may have a moment of inertia Izz of about 5900 g-$cm^2$ or higher.

Figure 5A:
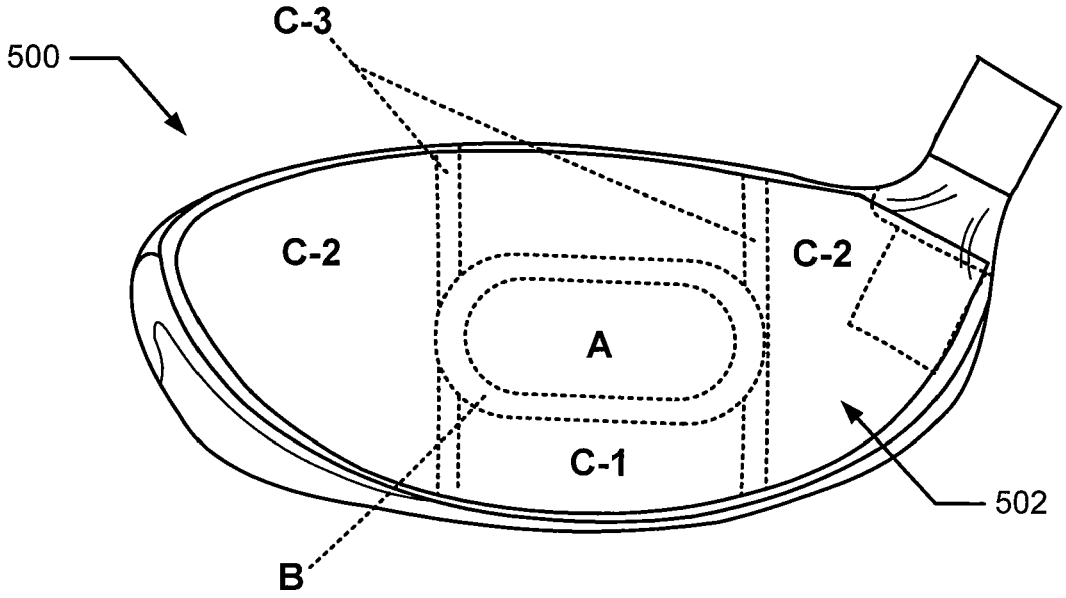
FIGS. 5A and 5B illustrate various views of a golf club head and its face member in accordance with another example of this invention.
Figure 5B:
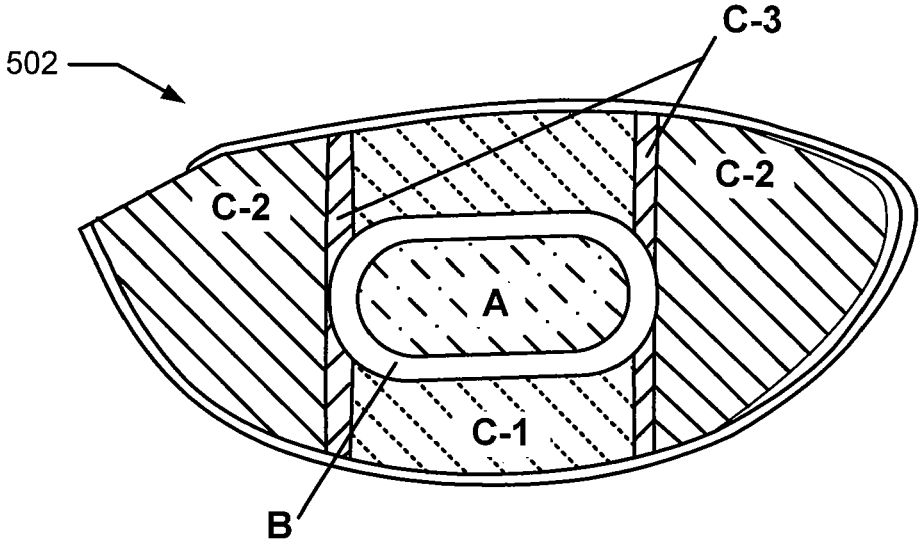

Other variable ball striking face thickness structures and arrangements are possible without departing from this invention. FIGS. 5A and 5B illustrate another example ball striking face 502 for a club head 500. While the overall club head body may be of the same general size, structure, and construction as those described above in conjunction with FIGS. 1 through 4G, in this example club head structure 500 the ball striking face 502 has a more complex thickness variation structure. More specifically, this specific example ball striking face has the following characteristics:

TABLE 9

| Another Example Club Head Structure | | |
|---|---|---|
| Face Region (From FIGS. 5A and 5B) | Thickness | Area |
| Region A | 3.2 mm | 709 $mm^2$ |
| Region B | Taper - 3.2 to 2.25 mm | 578 $mm^2$ |
| Region C-1 | 2.25 mm | 763 $mm^2$ (divided between two parts) |
| Region C-2 | 2.35 mm | 2212 $mm^2$ (divided between two parts) |

TABLE 9-continued

| Another Example Club Head Structure | | |
|---|---|---|
| Face Region (From FIGS. 5A and 5B) | Thickness | Area |
| Region C-3 | Taper - 2.25 to 2.35 mm | 317 $mm^2$ (divided between multiple parts) |

The various multiple parts of regions C-1, C-2, and C-3 need not be the same sizes and need not be of the same thicknesses in all examples of structures according to this invention. Also, many other variations in the variable face thickness (e.g., sizes, locations, thickness, tapering, thickness change characteristics, etc.) may be used without departing from this invention. If desired, the raised central portion A, the tapered region B, and the overall club head may have sizes like those described in Table 6.

Figure 6:
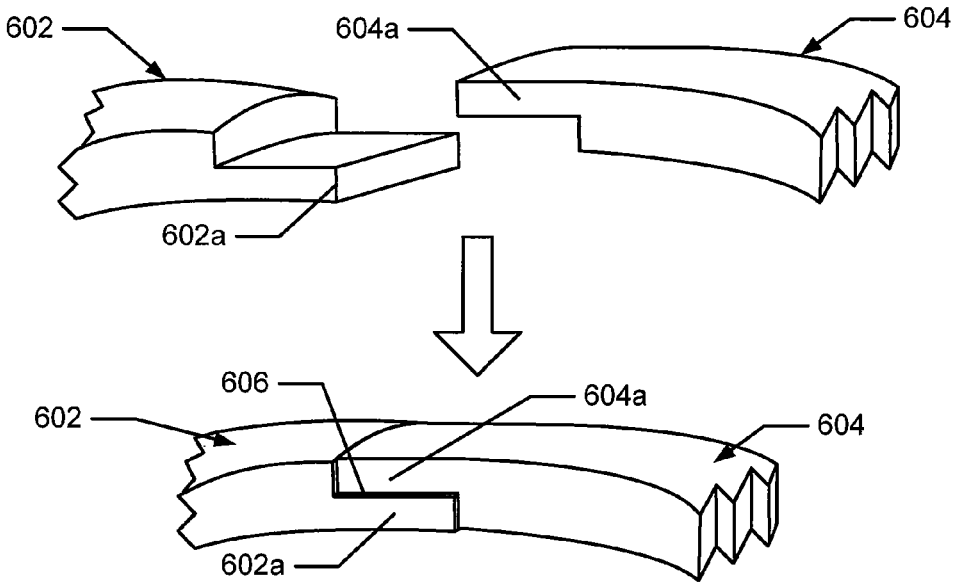
FIG. 6 illustrates an example joint structure that may be used for various parts of a golf club structure in accordance with this invention.
Figure 4A:
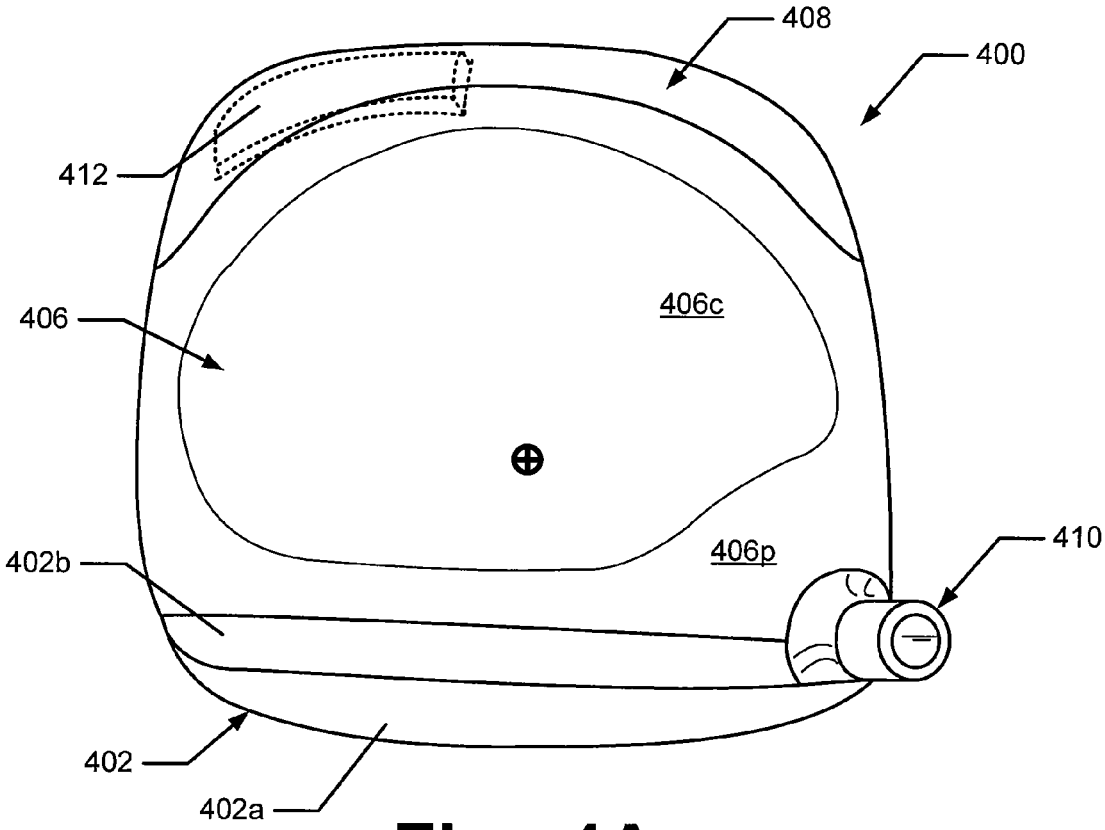
FIGS. 4A through 4G illustrate various views of a golf club head and its face member in accordance with another example of this invention
Figure 4B:
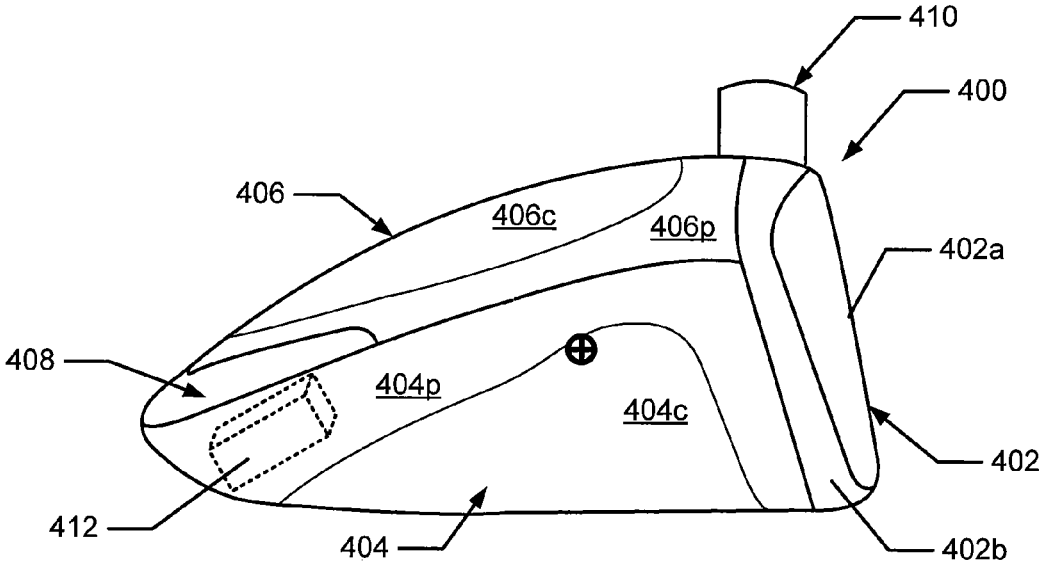
Figure 4C:
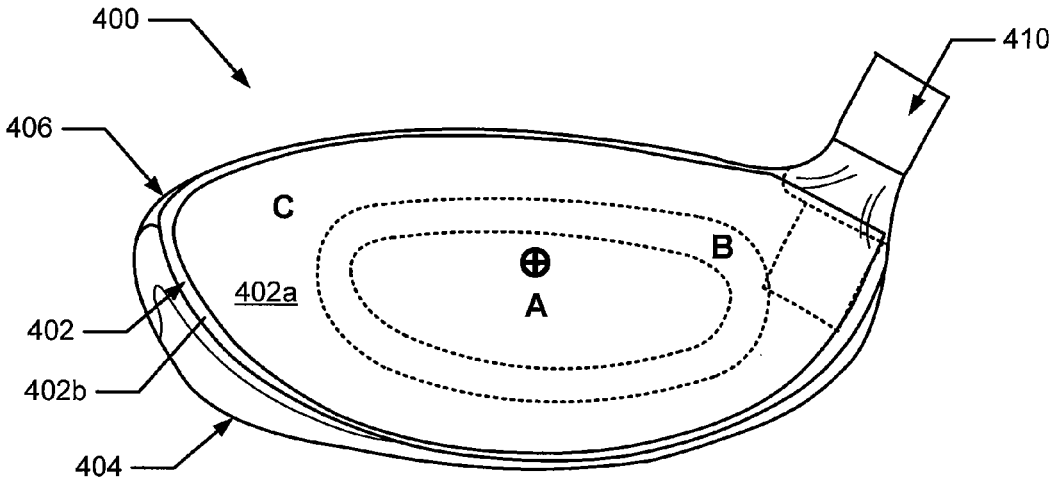
Figure 4D:
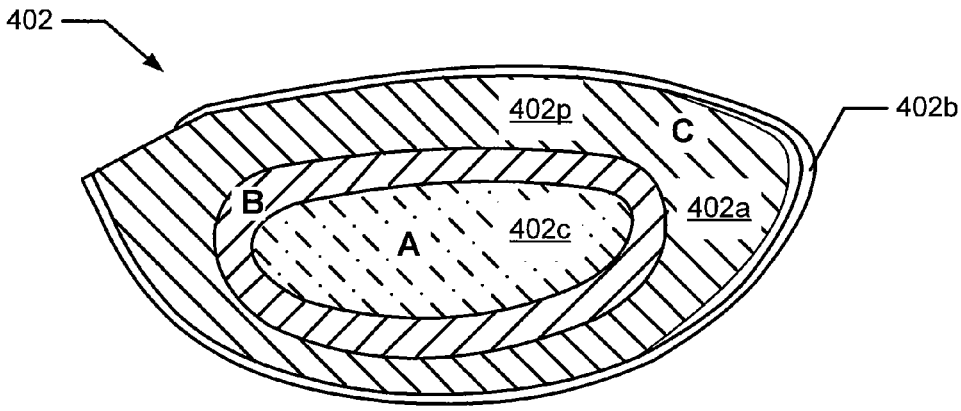
Figure 4G:
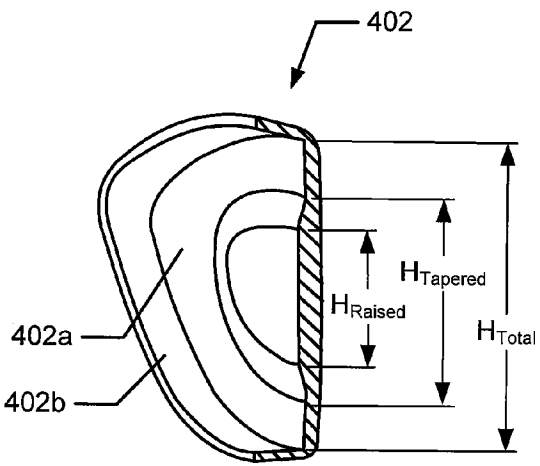
Figure 4E:
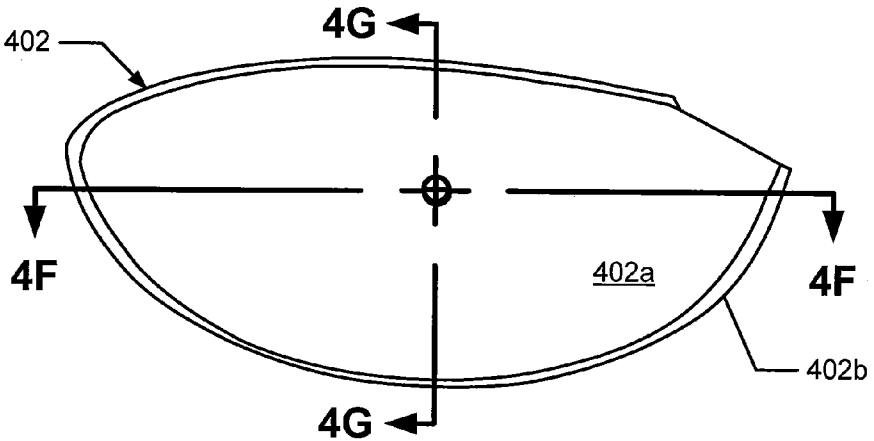
Figure 4F:
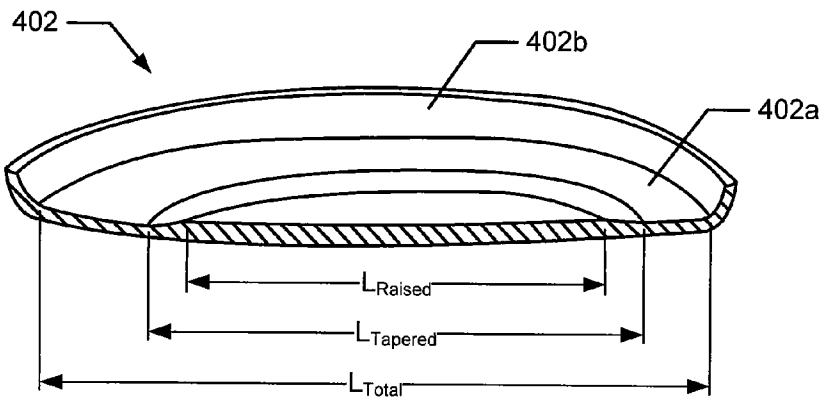

As described above, various parts of golf club head structures in accordance with examples of this invention (e.g., the face, sole, crown, and rear members) may be joined together by various methods, such as through the use of cements or adhesives; mechanical connectors, optionally releasable mechanical connections; and/or welding, soldering, brazing, or other fusing techniques. FIG. 6 helps illustrate this engagement procedure. More specifically, as illustrated in FIG. 6, one body part 602 (such as the crown member or the sole member) may include a ledge member 602*a* formed to lie adjacent a ledge member 604*a* of another body part 604 (such as the return portion of a cup face). This action forms the junction area 606. The two parts 602 and 604 may be joined together at the junction area, e.g., by adhesives, welding, or the like, to thereby fix the various parts together at a smooth junction. If desired, a finish may be applied over to conceal the junction (e.g., paint, chrome or other metal plating, polymeric coatings, etc.).

Golf club heads in accordance with at least some examples of this invention, e.g., as specifically described above, may have high moment of inertias, particularly about a vertical axis passing through the center of gravity (Izz). The use of strong and lightweight materials in some or all of the club head parts, such as titanium and titanium alloys (e.g., VL-Ti in the cup face component, KS120 titanium alloy in the crown and/or sole components, or other titanium alloys conventionally used in golf club head construction), and the use of selective machining techniques to produce precisely located thinned areas, such as chemical etching, produce substantial weight savings and allow club head designers to selectively place weight at desired locations to affect club head properties and/or ball flight characteristics (e.g., to fade or draw bias the club, etc.). The overall head weight (e.g., at least about 190 grams or even about 200 grams for the metal parts) provides a relatively heavy head weight to promote high swing speeds. Moreover, the multiple-thickness cup face described above provides improved ball speed over a larger area of the ball striking face.

Features of this invention may be used for producing a wide variety of wood-type golf club head structures. While driver type structures generally have been described above in detail and illustrated in the attached drawings, other types of club head structures that may be produced in accordance with at least some examples of this invention include: fairway woods (e.g., 2 through 13 woods), wood-type hybrid clubs, and the like.

Many modifications to the overall club head structures and/or the overall golf club structures may be made without departing from this invention. For example, many modifications may be made to the part or parts making up the club head structures, to the materials used in making the club head structures, to the manner in which the parts of the club head structures are joined together, etc. Also, many modifications may be made to the thickness, weight, shape, size, and/or other physical characteristics of the part or parts making up the overall golf club structure, etc. Further modifications may be made in the manner in which the club head and its associated parts are made, including modifications in the specific processes used to make the parts, modifications in the materials used to make the parts, modifications to the order in which the parts are made and the club head is assembled, and the like.

CONCLUSION

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

We claim:

1. A wood-type golf club head, comprising:

a cup face member including:

a ball striking face portion; and a return portion extending from a perimeter area of the ball striking face portion;

a first body member engaged with the return portion, the first body member including at least part of a sole portion of the golf club head;

a second body member engaged with the return portion at a first seam, the second body member including at least part of a crown portion of the golf club head;

a third body member engaged with the first body member and the second body member, wherein the third body member extends across a rear portion of the golf club head from a heel side to a toe side of the club head, and wherein the second body member is located between and separates at least some portion of the third body member from the return portion; and a weight member engaged with the third body member, wherein the weight member is located proximate the rear portion of the golf club head, wherein the second body member is engaged with the third body member at a second seam, wherein the second body member includes:

a central area; and a perimeter area, wherein the perimeter area surrounds the central area and is positioned between the first seam at which the second body member meets the return portion of the cup face member and the second seam at which the second body member meets the third body member, wherein the central area is thinner than the perimeter area.

2. A wood-type golf club head according to claim 1, wherein the first body member is engaged with the second body member.

3. A wood-type golf club head according to claim 1, further comprising:

a hosel member engaged with at least one of the cup face member and the second body member.

4. A wood-type golf club head according to claim 3, wherein each of the cup face member, the first body member, the second body member, the third body member, and the hosel member is made, at least in part, from titanium metal or a titanium-containing alloy material.

5. A wood-type golf club head according to claim 1, wherein the ball striking face portion has a variable face thickness.

6. A wood-type golf club head according to claim 5, wherein a central area of the ball striking face portion is thicker than a perimeter area of the ball striking face portion.

7. A wood-type golf club head according to claim 5, wherein the ball striking face portion has a central area having a first thickness, a perimeter area having a second thickness, and at least one transition region at least partially transitioning from the first thickness to the second thickness.

8. A wood-type golf club head according to claim 1, wherein exposed surfaces of the cup face member, the first body member, the second body member, and the third body member define at least 75% of an exterior surface area of the golf club head.

9. A wood-type golf club head according to claim 1, wherein exposed surfaces of the cup face member, the first body member, the second body member, and the third body member define at least 90% of an exterior surface area of the golf club head.

10. A wood-type golf club head according to claim 1, wherein the club head has a moment of inertia Izz of at least 5200 g-cm$^2$.

11. A wood-type golf club head according to claim 1, wherein the club head has a moment of inertia Izz of at least 5800 g-cm$^2$.

12. A wood-type golf club head according to claim 1, wherein each of the cup face member, the first body member, the second body member, and the third body member is made, at least in part, from titanium metal or a titanium-containing alloy material.

13. A wood-type golf club head according to claim 1, wherein the club head has a volume of at least 450 cc.

14. A wood-type golf club head according to claim 1, wherein the club head has an overall length dimension of at least 4.5 inches.

15. A wood-type golf club head according to claim 14, wherein the club head has an overall breadth dimension of 4.5 to 5.5 inches.

16. A wood-type golf club head according to claim 1, wherein the club head has an overall length dimension of at least 4.75 inches.

17. A wood-type golf club head according to claim 1, wherein the club head has an overall breadth dimension of 4.5 to 5.5 inches.

18. A wood-type golf club head according to claim 1, wherein the ball striking face portion has a central area having a first thickness, a perimeter area having a second thickness, and at least one transition region at least partially transitioning from the first thickness to the second thickness; wherein the cup face member, the first body member, the second body member, and the third body member, at least in part, define a hollow club head body; wherein exposed surfaces of the cup face member, the first body member, the second body member, and the third body member define at least 75% of an exterior surface area of the golf club head; wherein the club head has a moment of inertia Izz of at least 5500 g-cm$^2$; wherein each of the cup face member, the first body member, the second body member, and the third body member is made, at least in part, from titanium metal or a titanium-containing alloy material; wherein the club head has a volume of at least 450 cc; wherein the club head has an overall length dimension of at least 4.5 inches; and wherein the club head has an overall breadth dimension of 4.5 to 5.5 inches.

19. A wood-type golf club head according to claim 18, wherein the overall length dimension is at least 4.75 inches.

20. A wood-type golf club head, comprising:

a cup face member including a ball striking face portion and a return portion extending from a perimeter area of the ball striking face portion;

a first body member engaged with the return portion, the first body member including at least part of a sole portion of the golf club head;

a second body member engaged with the return portion at a first seam, the second body member including at least part of a crown portion of the golf club head;

a third body member engaged with the first body member and the second body member, wherein the third body member extends across a rear portion of the golf club head from a heel side to a toe side of the club head, and wherein the second body member is located between and separates at least some portion of the third body member from the return portion; and a hosel member engaged with at least one of the cup face member and the second body member, wherein the second body member is engaged with the third body member at a second seam, wherein the second body member includes:

a central area; and a perimeter area, wherein the perimeter area surrounds the central area and is positioned between the first seam at which the second body member meets the return portion of the cup face member and the second seam at which the second body member meets the third body member, wherein the central area is thinner than the perimeter area.

21. A wood-type golf club head according to claim 20, wherein the first body member is engaged with the second body member.

22. A wood-type golf club head according to claim 20, further comprising:

at least one weight member located proximate a rear perimeter portion of the golf club head.

23. A wood-type golf club head according to claim 20, wherein the ball striking face portion has a variable face thickness.

24. A wood-type golf club head according to claim 23, wherein a central area of the ball striking face portion is thicker than a perimeter area of the ball striking face portion.

25. A wood-type golf club head according to claim 23, wherein the ball striking face portion has a central area having a first thickness, a perimeter area having a second thickness, and at least one transition region at least partially transitioning from the first thickness to the second thickness.

26. A wood-type golf club head according to claim 20, wherein exposed surfaces of the cup face member, the first body member, the second body member, and the third body member define at least 75% of an exterior surface area of the golf club head.

27. A wood-type golf club head according to claim 20, wherein exposed surfaces of the cup face member, the first body member, the second body member, and the third body member define at least 90% of an exterior surface area of the golf club head.

28. A wood-type golf club head according to claim 20, wherein the club head has a moment of inertia Izz of at least 5200 g-cm$^2$.

29. A wood-type golf club head according to claim 20, wherein the club head has a moment of inertia Izz of at least 5800 g-cm$^2$.

30. A wood-type golf club head according to claim 20, wherein each of the cup face member, the first body member, the second body member, and the third body member is made, at least in part, from titanium metal or a titanium-containing alloy material.

31. A wood-type golf club head according to claim 20, wherein the club head has a volume of at least 450 cc.

32. A wood-type golf club head according to claim 20, wherein the club head has an overall length dimension of at least 4.5 inches.

33. A wood-type golf club head according to claim 32, wherein the club head has an overall breadth dimension of 4.5 to 5.5 inches.

34. A wood-type golf club head according to claim 20, wherein the club head has an overall length dimension of at least 4.75 inches.

35. A wood-type golf club head according to claim 20, wherein the club head has an overall breadth dimension of 4.5 to 5.5 inches.

36. A wood-type golf club head according to claim 20, wherein each of the cup face member, the first body member, the second body member, the third body member, and the hosel member is made, at least in part, from titanium metal or a titanium-containing alloy material.

37. A wood-type golf club head according to claim 20, wherein the ball striking face portion has a central area having a first thickness, a perimeter area having a second thickness, and at least one transition region at least partially transitioning from the first thickness to the second thickness; wherein the cup face member, the first body member, the second body member, and the third body member, at least in part, define a hollow club head body; wherein exposed surfaces of the cup face member, the first body member, the second body member, and the third body member define at least 75% of an exterior surface area of the golf club head; wherein the club head has a moment of inertia Izz of at least 5500 g-cm$^2$; wherein each of the cup face member, the first body member, the second body member, and the third body member is made, at least in part, from titanium metal or a titanium-containing alloy material; wherein the club head has a volume of at least 450 cc; wherein the club head has an overall length dimension of at least 4.5 inches; and wherein the club head has an overall breadth dimension of 4.5 to 5.5 inches.

38. A wood-type golf club head according to claim 37, wherein the overall length dimension is at least 4.75 inches.

39. A wood-type golf club head, comprising:

a club head body including a heel portion, a toe portion, a crown portion, a sole portion, and a rear portion, wherein the rear portion includes a first increased weight zone;

a ball striking face engaged with the club head body, wherein the ball striking face is located at a portion of the club head body remote from the first increased weight zone and extends from the toe portion to the heel portion, and wherein the ball striking face has a variable thickness; and a return portion extending from a perimeter area of the ball striking face, wherein the rear portion is engaged with the sole portion and the crown portion and extends across the golf club head from the heel portion to the toe portion of the club head, and wherein the crown portion is located between and separates at least some portion of the rear portion from the return portion, wherein the crown portion engages with the return portion at a first seam, wherein the club head has a moment of inertia Izz of at least 5500 g-cm$^2$; wherein the club head has a volume of at least 450 cc; wherein the club head has an overall length dimension of at least 4.5 inches; and wherein the club head has an overall breadth dimension of 4.5 to 5.5 inches, wherein the crown portion is engaged with the rear portion at a second seam, wherein the crown portion includes:

a central area; and a perimeter area, wherein the perimeter area surrounds the central area and is positioned between the first seam at which the crown portion meets the return portion and the second seam at which the crown portion meets the rear portion, wherein the central area is thinner than the perimeter area.

40. A wood-type golf club head according to claim 39, wherein the overall length dimension is at least 4.75 inches.

41. A wood-type golf club head according to claim 39, wherein a central area of the ball striking face is thicker than a perimeter area of the ball striking face.

42. A wood-type golf club head according to claim 39, wherein the ball striking face has a central area having a first thickness, a perimeter area having a second thickness, and at least one transition region at least partially transitioning from the first thickness to the second thickness.

43. A wood-type golf club head according to claim 39, wherein the ball striking face has a first area having a first thickness, a second area having a second thickness, and at least one transition region at least partially transitioning from the first thickness to the second thickness.

44. A wood-type golf club head according to claim 39, wherein the ball striking face constitutes part of a cup face member engaged with the club head body.

45. A wood-type golf club head according to claim 39, wherein the club head body constitutes a multi-part construction.

46. A wood-type golf club head according to claim 45, wherein the ball striking face constitutes part of a cup face member engaged with multiple parts of the multi-part club head body construction.

47. A wood-type golf club head according to claim 39, wherein a majority of the club head body is constructed from at least one member selected from the group of: titanium metal or titanium-containing alloy materials.

48. A wood-type golf club head according to claim 47, wherein a majority of the ball striking face is constructed from at least one member selected from the group of: titanium metal or titanium-containing alloy materials.

49. A wood-type golf club head according to claim 39, wherein more than 90% of the club head body is constructed from at least one member selected from the group of: titanium metal or titanium-containing alloy materials.

50. A wood-type golf club head according to claim 49, wherein more than 90% of the ball striking face is constructed from at least one member selected from the group of: titanium metal or titanium-containing alloy materials.

51. A wood-type golf club, comprising:

a cup face member including a ball striking face portion and a return portion extending from a perimeter area of the ball striking face portion;

a golf club body engaged with the cup face member, the golf club body including:

a first body member engaged with the return portion, the first body member including at least part of a sole portion, a second body member engaged with the return portion at a first seam, the second body member including at least part of a crown portion, and a third body member engaged with the first body member and the second body member, wherein the third body member extends across a rear portion of the golf club body from a heel side to a toe side of the golf club body, and wherein the second body member is located between and separates at least some portion of the third body member from the return portion, and a weight member engaged with the third body member, wherein the weight member is located proximate the rear portion of the golf club body; and a shaft member engaged with at least one of the golf club body and the cup face member, wherein the second body member is engaged with the third body member at a second seam, wherein the second body member includes:

a central area; and a perimeter area, wherein the perimeter area surrounds the central area and is positioned between the first seam at which the second body member meets the return portion of the cup face member and the second seam at which the second body member meets the third body member, wherein the central area is thinner than the perimeter area.

52. A wood-type golf club, comprising:

a cup face member including a ball striking face portion and a return portion extending from a perimeter area of the ball striking face portion;

a club head body engaged with the cup face member, the club head body including:

a first body member engaged with the return portion at a first seam, the first body member including at least part of a sole portion, a second body member engaged with the return portion, the second body member including at least part of a crown portion, and a third body member engaged with the first body member and the second body member, wherein the third body member extends across a rear portion of the club head body from a heel side to a toe side of the club head body, and wherein the second body member is located between and separates at least some portion of the third body member from the return portion;

a hosel member engaged with at least one of the cup face member and the club head body; and a shaft member engaged with the hosel member, wherein the second body member is engaged with the third body member at a second seam, wherein the second body member includes:

a central area; and a perimeter area, wherein the perimeter area surrounds the central area and is positioned between the first seam at which the second body member meets the return portion of the cup face member and the second seam at which the second body member meets the third body member, wherein the central area is thinner than the perimeter area.

53. A wood-type golf club, comprising:

a club head including:

a club head body including a heel portion, a toe portion, a crown portion, a sole portion, and a rear portion, wherein the rear portion includes a first increased weight zone, a ball striking face engaged with the club head body, wherein the ball striking face is located at a portion of the club head body remote from the first increased weight zone and extends from the toe portion to the heel portion, and wherein the ball striking face has a variable thickness; and a return portion extending from a perimeter area of the ball striking face, wherein the rear portion is engaged with the sole portion and the crown portion and extends across the golf club head from the heel portion to the for portion of the club head, and wherein the crown portion is located between and separates at least some portion of the rear portion from the return portion, wherein the crown portion engages with the return portion at a first seam, wherein the club head has a moment of inertia Izz of at least 5500 g-cm$^2$; wherein the club head has a volume of at least 450 cc; wherein the club head has an overall length dimension of at least 4.5 inches; and wherein the club head has an overall breadth dimension of 4.5 to 5.5 inches; and a shaft member engaged with the club head, wherein the crown portion is engaged with the rear portion at a second seam, wherein the crown portion includes:

a central area; and a perimeter area, wherein the perimeter area surrounds the central area and is positioned between the first seam at which the crown portion meets the return portion and the second seam at which the crown portion meets the rear portion, wherein the central area is thinner than the perimeter area.

* * * * *